US011046071B2

(12) United States Patent
Martin et al.

(10) Patent No.: US 11,046,071 B2
(45) Date of Patent: Jun. 29, 2021

(54) ON-DIE ACTUATOR DISABLING

(71) Applicant: HEWLETT-PACKARD DEVELOPMENT COMPANY, L.P., Spring, TX (US)

(72) Inventors: Eric Martin, Corvallis, OR (US); Daryl E Anderson, Corvallis, OR (US); James Michael Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/483,513

(22) PCT Filed: Apr. 5, 2017

(86) PCT No.: PCT/US2017/026118
§ 371 (c)(1),
(2) Date: Aug. 5, 2019

(87) PCT Pub. No.: WO2018/186850
PCT Pub. Date: Oct. 11, 2018

(65) Prior Publication Data

US 2020/0338883 A1 Oct. 29, 2020

(51) Int. Cl.
*B41J 2/045* (2006.01)
*B41J 2/14* (2006.01)

(52) U.S. Cl.
CPC ..... *B41J 2/0451* (2013.01); *B41J 2/14153* (2013.01)

(58) Field of Classification Search
CPC ..... B41J 2/0451; B41J 2/14153
See application file for complete search history.

(56) References Cited

U.S. PATENT DOCUMENTS 6,068,360 A 5/2000 Hiwada
6,460,964 B2 10/2002 Osborne
7,934,800 B2 5/2011 Silverbrook et al.
(Continued)

FOREIGN PATENT DOCUMENTS

CN 101522428 9/2009
CN 104080610 A 10/2014
(Continued)

OTHER PUBLICATIONS

Hewlett-Packard Development Company, L.P. HP PageWide Technology Technical White Paper. Dec. 2012.

*Primary Examiner* — Sharon Polk
(74) *Attorney, Agent, or Firm* — Fabian VanCott

(57) ABSTRACT

In one example in accordance with the present disclosure, a fluid ejection die is described. The die includes a number of actuator sensors disposed on the fluid ejection die to sense a characteristic of a corresponding actuator. Each actuator sensor is coupled to a respective actuator and multiple coupled actuator sensors and actuators are grouped as primitives on the fluid ejection die. The die also includes an actuator evaluation die per primitive to evaluate an actuator characteristic of any actuator within the primitive. The die also includes a number of disable devices. Each disable device 1) is coupled to a respective actuator of the number of actuators and 2) disables a corresponding actuator when the corresponding actuator is determined to be malfunctioning.

20 Claims, 7 Drawing Sheets

(56) References Cited

U.S. PATENT DOCUMENTS

| | | | |
|---|---|---|---|
| 8,336,981 | B2 | 12/2012 | Chen et al. |
| 9,493,002 | B2 | 11/2016 | Edelen et al. |
| 2014/0232791 | A1 | 8/2014 | Gardner et al. |
| 2015/0029250 | A1 | 1/2015 | Van Brocklin et al. |
| 2015/0062211 | A1* | 3/2015 | Tamura ..... B41J 2/0451 347/9 |
| 2015/0360491 | A1 | 12/2015 | Billow |

FOREIGN PATENT DOCUMENTS

| | | |
|---|---|---|
| CN | 104097398 | 10/2014 |
| CN | 105939858 | 9/2016 |
| JP | 2015180549 | 10/2015 |
| WO | WO-2012003218 | 1/2012 |
| WO | WO-2015163861 | 10/2015 |
| WO | WO-2016175740 A1 | 11/2016 |
| WO | WO-2016175853 A1 | 11/2016 |
| WO | WO-2017018973 | 2/2017 |

* cited by examiner

ON-DIE ACTUATOR DISABLING

BACKGROUND

A fluid ejection die is a component of a fluid ejection system that includes a number of nozzles. The dies can also include other actuators such as micro-recirculation pumps. Through these nozzles and pumps, fluid, such as ink and fusing agent among others, is ejected or moved. Over time, these nozzles and actuators can become clogged or otherwise inoperable. As a specific example, over time, ink in a printing device can harden and crust thereby blocking the nozzle and interrupting the operation of subsequent ejection events. Other examples of issues affecting these actuators include fluid fusing on an ejecting element, particle contamination, surface puddling and surface damage to die structures. These and other problems may adversely affect operations of the device in which the die is installed.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1A:
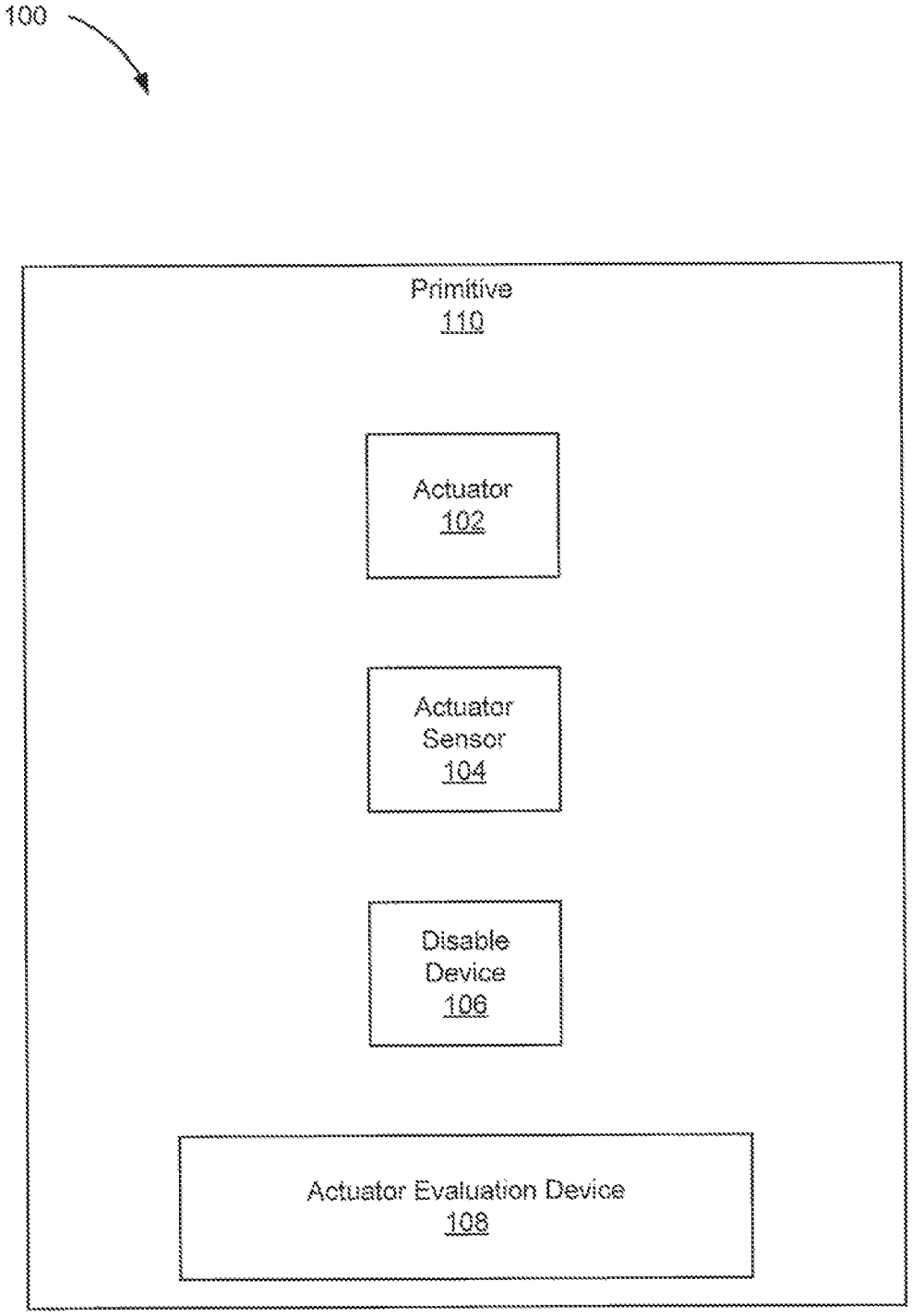
FIGS. 1A and 1B are block diagrams of a fluid ejection die including on-die actuator disabling and activation-forwarding components, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

A fluid ejection die is a component of a fluid ejection system that includes a number of actuators. These actuators may come in the form of nozzles that eject fluid from a die, or non-ejecting actuators, such as recirculation pumps that circulate fluid throughout the fluid channels on the die. Through these nozzles and pumps, fluid, such as ink and fusing agent among others, is ejected or moved.

Specific examples of devices that rely on fluid ejection systems include, but are not limited to, inkjet printers, multi-function printers (MFPs), and additive manufacturing apparatuses. The fluid ejection systems in these systems are widely used for precisely, and rapidly, dispensing small quantities of fluid. For example, in an additive manufacturing apparatus, the fluid ejection system dispenses fusing agents. The fusing agent is deposited on a build material, which fusing agent facilitates the hardening of build material to form a three-dimensional product.

Other fluid ejection systems dispense ink on a two-dimensional print medium such as paper. For example, during inkjet printing, ink is directed to a fluid ejection die. Depending on the content to be printed, the device in which the fluid ejection system is disposed, determines the time and position at which the ink drops are to be released/ejected onto the print medium. In this way, the fluid ejection die releases multiple ink drops over a predefined area to produce a representation of the image content to be printed. Besides paper, other forms of print media may also be used.

Accordingly, as has been described, the systems and methods described herein may be implemented in a two-dimensional printing operation, i.e., depositing fluid on a substrate, and in a three-dimensional printing operation, i.e., depositing a fusing agent on a material base to form a three-dimensional printed product.

To eject the fluid, these fluid ejection dies include nozzles and other actuators. Fluid is ejected from the die via nozzles and is moved throughout the die via other actuators, such as pumps. The fluid ejected through each nozzle comes from a corresponding fluid reservoir in fluid communication with the nozzle.

To eject the fluid, each nozzle includes various components. For example, a nozzle includes an ejector, an ejection chamber, and a nozzle orifice. An ejection chamber of the nozzle holds an amount of fluid. An ejector in the ejection chamber operates to ejected fluid out of the ejection chamber, through the nozzle orifice. The ejector may include a thermal resistor or other thermal device, a piezoelectric element, or other mechanism for ejecting fluid from the firing chamber.

While such fluid ejection systems and dies undoubtedly have advanced the field of precise fluid delivery, some conditions impact their effectiveness. For example, the nozzles on a die are subject to many cycles of heating, drive bubble formation, drive bubble collapse, and fluid replenishment from a fluid reservoir. Over time, and depending on other operating conditions, the actuators may become blocked or otherwise defective. For example, particulate matter, such as dried ink or powder build material, can block the nozzle. This particulate matter can adversely affect the formation and release of subsequent printing fluid. Other examples of scenarios that may impact the operation of a printing device include a fusing of the printing fluid on the ejector element, surface puddling, and general damage to components within the nozzle. As the process of depositing fluid on a surface is a precise operation, these blockages can have a deleterious effect on print quality. If one of these actuators fails, and is continually operating following failure, then it may cause neighboring actuators to fail and/or result in catastrophic failure.

Accordingly, the present specification describes a method to accommodate a malfunctioning nozzle or other actuator. Specifically, the present specification describes a die that includes on-die components 1) that evaluate whether an actuator is operating as expected and 2) if an actuator is not functioning as expected, can disable the actuator from continuing to operate thereby reducing any negative impact that a malfunctioning actuator may have on the operations of the device. In some examples, in addition to disabling the actuator, the on-die components may activate another actuator in place of the malfunctioning actuator. For example, if one nozzle is not firing properly, then that nozzle may be disabled, and a neighbor nozzle may instead be activated in place of the malfunctioning nozzle. Doing so ensures that printing, or any other operation, carries on as intended while reducing the impact of the malfunctioning nozzle.

Specifically, the present specification describes a fluid ejection die. The fluid ejection die includes a number of actuator sensors disposed on the fluid ejection die to sense a characteristic of a corresponding actuator. Each actuator sensor of the number of actuator sensors is coupled to a respective actuator of the number of actuators and multiple coupled actuator sensors and actuators are grouped as primitives on the fluid ejection die. The fluid ejection die also includes an actuator evaluation device per primitive to evaluate an actuator characteristic of any actuator within the primitive. The die also includes a number of disable devices. Each disable device 1) is coupled to a respective actuator of the number of actuators and 2) disables a corresponding actuator when the corresponding actuator is determined to be malfunctioning.

The present specification also describes a fluid ejection system that includes multiple fluid ejection dies. A fluid ejection die includes a number of drive bubble detection devices to output a first voltage indicative of a state of a corresponding actuator. Each drive bubble detection device is coupled to a respective actuator and multiple coupled drive bubble detection devices and actuators are grouped as primitives on the fluid ejection die. Each die also includes an actuator evaluation device per primitive to evaluate an actuator characteristic of the actuator based at least in part on a comparison of the first voltage and a threshold voltage.

Each fluid ejection die also includes a number of disable devices. Each disable device 1) is coupled to a respective actuator of the number of actuators and 2) disables a corresponding actuator when the corresponding actuator is determined to be malfunctioning. Each fluid ejection die also includes a number of forwarding devices. Each forwarding device 1) is coupled to a respective actuator of the number of actuators and 2) forwards an activation pulse originally directed towards the first actuator to a second actuator, when the first actuator is determined to be malfunctioning.

The present specification also describes a method for evaluating actuator characteristics on a fluid ejection die, disabling an actuator, and in some cases forwarding an activation pulse to a different actuator. According to the method, an activation pulse for activating an actuator of a primitive is received and the actuator is activated based on the activation pulse. The activation event generates a first voltage output by a corresponding actuator sensor. The corresponding actuator sensor is also disposed on the fluid ejection die and is coupled to the actuator. An actuator characteristic is then evaluated at an actuator evaluation device shared by multiple actuators of the primitive based at least in part on a comparison of the first voltage and a threshold voltage. The actuator is then disabled when a comparison indicates the selected actuator is malfunctioning.

In this example, the actuator sensor, actuator, and evaluation components are disposed on the fluid ejection die itself as opposed to being off die, for example as a part of printer circuitry or other fluid ejection system circuitry. When such actuator evaluation circuitry is not on the fluid ejection die, gathered information from an actuator sensor is passed off die where it is used to determine a state of the corresponding actuator. Accordingly, by incorporating these elements directly on the fluid ejection die, increased technical functionality of a fluid ejection die is enabled. For example, printer-die communication bandwidth is reduced when sensor information is not passed off-die, but is rather maintained on the fluid ejection die when evaluating an actuator. On-die circuitry also reduces the computational overhead of the printer in which the fluid ejection die is disposed. Still further, having such actuator evaluation circuitry on the fluid ejection die itself removes the printer from managing actuator service and/or repair and localizes it to the die itself. Additionally, by not locating such sensing and evaluation circuitry off-die, but maintaining it on the fluid ejection die, there can be faster responses to malfunctioning actuators. Still further, positioning this circuitry on the fluid ejection die reduces the sensitivity of these components to electrical noise that could corrupt the signals if they were driven off the fluid ejection die.

In summary, using such a fluid ejection die 1) allows for actuator evaluation, disabling, and replacement circuitry to be disposed on the die itself, as opposed to sending sensed signals to nozzle evaluation circuitry off die; 2) increases the efficiency of bandwidth usage between the device and die; 3) reduces computation overhead for the device in which the fluid ejection die is disposed; 4) provides improved resolution times for malfunctioning actuators; 5) allows for actuator evaluation in one primitive while allowing continued operation of actuators in another primitive; and 6) places management of nozzles on the fluid ejection die as opposed to on the printer in which the fluid ejection die is installed. However, it is contemplated that the devices disclosed herein may address other matters and deficiencies in a number of technical areas.

As used in the present specification and in the appended claims, the term "actuator" refers to a nozzle or another non-ejecting actuator. For example, a nozzle, which is an actuator, operates to eject fluid from the fluid ejection die. A recirculation pump, which is an example of a non-ejecting actuator, moves fluid throughout the fluid slots, channels, and pathways within the fluid ejection die.

Accordingly, as used in the present specification and in the appended claims, the term "nozzle" refers to an individual component of a fluid ejection die that dispenses fluid onto a surface. The nozzle includes at least an ejection chamber, an ejector, and a shared nozzle orifice.

Further, as used in the present specification and in the appended claims, the term "fluid ejection die" refers to a component of a fluid ejection device that includes a number of nozzles through which a printing fluid is ejected. Groups of actuators are categorized as "primitives" of the fluid ejection die. In one example, a primitive may include between 8-16 actuators. The fluid ejection die may be organized first into two columns with 30-150 primitives per column.

Even further, as used in the present specification and in the appended claims, the term "a number of" or similar language is meant to be understood broadly as any positive number including 1 to infinity.

Figure 1B:
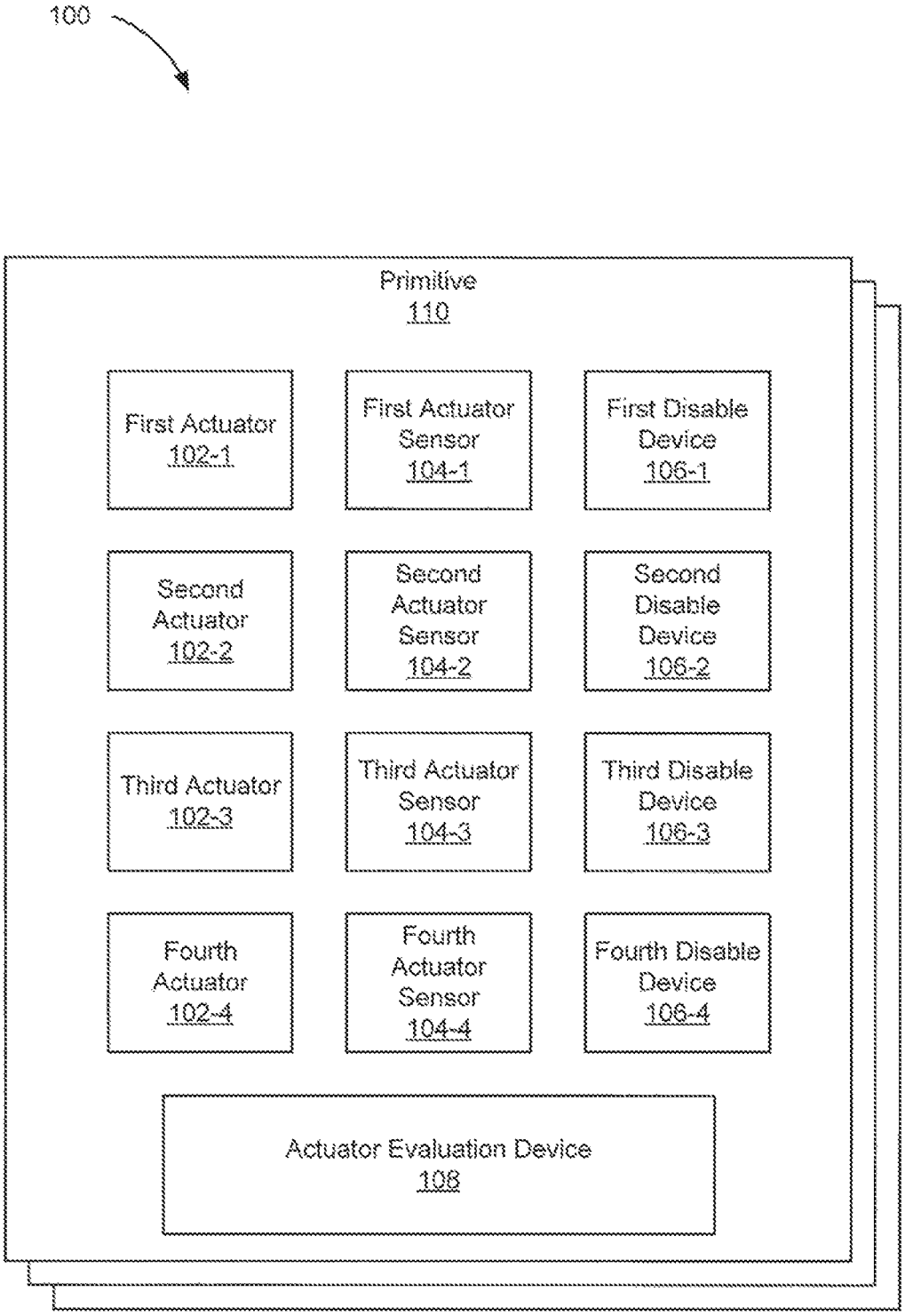

FIGS. 1A and 1B are block diagrams of a fluid ejection die (100) including on-die actuator disabling and activation-forwarding components, according to an example of the principles described herein. As described above, the fluid ejection die (100) is a component of a fluid ejection system that houses components for ejecting fluid and/or transporting fluid along various pathways. The fluid that is ejected and moved throughout the fluid ejection die (100) can be of various types including ink, biochemical agents, and/or fusing agents.

FIG. 1A depicts a fluid ejection die (100) with an actuator (102), an actuator sensor (104), a disable device (106), and an actuator evaluation device (108) disposed on a primitive (110). FIG. 1B depicts a fluid ejection die (100) with multiple actuators (102), multiple actuator sensors (104), multiple disable devices (106), and an actuator evaluation device (108) disponed on each primitive (110).

The fluid ejection die (100) includes various actuators (102) to eject fluid from the fluid ejection die (100) or to otherwise move fluid throughout the fluid ejection die (100). In some cases there may be one actuator (102) as depicted in FIG. 1A, in other examples there may be multiple actuators (102-1, 102-2, 102-3, 102-4) as depicted in FIG. 1B. The actuators (102) may be of varying types. For example, nozzles are one type of actuator (102) that operates to eject fluid from the fluid ejection die (100). Another type of actuator (102) is a recirculation pump that may be a component that moves fluid between a nozzle channel and a fluid slot that feeds the nozzle channel. While the present specification may make reference to a particular type of actuator (102), the fluid ejection die (100) may include any number and type of actuators (102). Also, within the figures the indication "~*" refers to a specific instance of a component. For example, a first actuator is identified as (102-1). By comparison, the absence of an indication "~*" refers to the component in general. For example, an actuator in general is referred to as an actuator (102).

Returning to the actuators (102). A nozzle is a type of actuator that ejects fluid originating in a fluid reservoir onto a surface such as paper or a build material volume. Specifically, the fluid ejected by the nozzles may be provided to the nozzle via a fluid feed slot in the fluid ejection die (100) that fluidically couples the nozzles to a fluid reservoir. In order to eject the fluid, each nozzle includes a number of components, including an ejector, an ejection chamber, and a nozzle orifice. An example of an ejector, ejection chamber, and a nozzle orifice are provided below in connection with FIG. 2B.

The fluid ejection die (100) also includes actuator sensors (104) disposed on the fluid ejection die (100). In some cases there may be one actuator sensor (104) as depicted in FIG. 1A, in other examples there may be multiple actuator sensors (104-1, 104-2, 104-3, 104-4) as depicted in FIG. 1B. The actuator sensors (104) sense a characteristic of a corresponding actuator. For example, the actuator sensors (104) may measure an impedance near an actuator (102). As a specific example, the actuator sensors (104) may be drive bubble detectors that detect the presence of a drive bubble within an ejection chamber of a nozzle.

A drive bubble is generated by an ejector element to move fluid in the ejection chamber. Specifically, in thermal inkjet printing, a thermal ejector heats up to vaporize a portion of fluid in an ejection chamber. As the bubble expands, it forces fluid out of the nozzle orifice. As the bubble collapses, a negative pressure within the ejection chamber draws fluid from the fluid feed slot of the fluid ejection die (100). Sensing the proper formation and collapse of such a drive bubble can be used to evaluate whether a particular nozzle is operating as expected. That is, a blockage in the nozzle will affect the formation of the drive bubble. If a drive bubble has not formed as expected, it can be determined that the nozzle is blocked and/or not working in the intended manner. The above process can also be used to determine the proper formation and collapse of a drive bubble related to a non-ejecting actuator such as a recirculation pump.

The presence of a drive bubble can be detected by measuring impedance values within the ejection chamber at different points in time. That is, as the vapor that makes up the drive bubble has a different conductivity than the fluid that otherwise is disposed within the chamber, when a drive bubble exists in the ejection chamber, a different impedance value will be measured. Accordingly, a drive bubble detection sensor measures this impedance and outputs a corresponding voltage. As will be described below, this output can be used to determine whether a drive bubble is properly forming and therefore determining whether the corresponding nozzle is in a functioning or malfunctioning state. This output can be used to trigger subsequent actuator (102) management operations. While description has been provided of an impedance measurement, other characteristics may be measured to determine the characteristic of the corresponding actuator (102).

As described above, in some examples such as that depicted in FIG. 1B, each actuator sensor (104) of the number of actuator sensors (104) may be coupled to a respective actuator (102) of the number of actuators (102). In one example, each actuator sensor (104) is uniquely paired with the respective actuator (102). For example, a first actuator (102-1) may be uniquely paired with a first actuator sensor (104-1). Similarly, the second actuator (102-2), third actuator (102-3), and fourth actuator (102-4) may be uniquely paired with the second actuator sensor (104-2), third actuator sensor (104-3), and fourth actuator sensor (104-4). Multiple pairings of actuators (102) and actuator sensors (104) may be grouped together in a primitive (110) of the fluid ejection die (100). That is, the fluid ejection die (100) may include any number of actuator (102)/actuator sensor (104) pairs grouped as primitives (110). Pairing the actuators (102) and actuator sensors (104) in this fashion increases the efficiency of actuator (102) management. While FIG. 16 depicts multiple actuators (102) and actuator sensors (104), a primitive (110) may have any number of actuator (102)/actuator sensor (104) pairs, including one, as depicted in FIG. 1A.

Including the actuator sensors (104) on the fluid ejection die (100), as opposed to some off die location such as on the printer, also increases efficiency. Specifically, it allows for sensing to occur locally, rather than off-die, which increases the speed with which sensing can occur.

The fluid ejection die (100) also includes an actuator evaluation device (108) per primitive (110). The actuator evaluation device (108) evaluates an actuator (102) based at least on an output of the actuator sensor (104). For example, a first actuator sensor (104-1) may output a voltage that corresponds to an impedance measurement within an ejection chamber of a first nozzle. This voltage may be compared against a threshold voltage, which threshold voltage delineates between an expected voltage with fluid present and an expected voltage with air present in the ejection chamber.

As a specific example, a voltage lower than the threshold voltage may indicate that fluid is present, which fluid has a lower impedance than fluid vapor. Accordingly, a voltage higher than the threshold voltage may indicate that vapor is present, which air has a higher impedance than fluid. Accordingly, at a time when a drive bubble is expected, a voltage output from an actuator sensor (104) that is higher than, or equal to, the threshold voltage would suggest the presence of a drive bubble while a voltage output from an actuator sensor (104) that is lower than the threshold voltage would suggest the lack of a drive bubble. In this case, as a drive bubble is expected, but the first voltage does not suggest such a drive bubble current is forming, it can be determined that the nozzle under test has a malfunctioning characteristic. While a specific relationship, i.e., low voltage indicates fluid, high voltage indicates vapor, has been described, any desired relationship can be implemented in accordance with the principles described herein.

In some examples, to property determine whether an actuator (102) is functioning as expected, the corresponding actuator sensor (104) may take multiple measurements relating to the corresponding actuator (102), and the actuator evaluation device (108) may evaluate multiple measurement values before outputting an indication of the state of the actuator (102). The different measured values may be taken at different time intervals following a firing event. Accordingly, the different measured values are compared against different threshold voltages. Specifically, the impedance measurements that indicate a properly forming drive bubble are a function of time. For example, a drive bubble at its largest yields a highest impedance, then as the bubble collapses over time, the impedance measure drops, due to the reduced amount of vapor in the ejection chamber while it refills with fluid. Accordingly, the threshold voltage that indicates a properly forming drive bubble also changes over time. Comparing multiple voltage values against multiple threshold voltages following a firing event provides greater confidence in a determined state of a particular actuator (102).

As can be seen in FIGS. 1A and 1B, the actuator evaluation device (108) is per primitive (110). That is the actuator evaluation device (108) interfaces with just those actuators (102) and just those actuator sensors (104) of that particular primitive (110). Put another way, a single actuator evaluation device (108) is shared among all the actuators (102) in the primitive (101).

The fluid ejection die (100) also includes a number of disable devices (106-1, 106-2, 106-3, 106-4). As with the number of actuator sensors (104), each of the disable devices (106) are coupled to a respective actuator (102) of the number of actuators (102), and in some cases uniquely paired with actuators (102) of the number of actuators (102). The disable devices (106) may disable the associated actuators (102) by preventing an activation pulse intended for the specific actuator (102) from reaching that actuator (102). For example, upon a determination by the actuator evaluation device (108) that a first actuator (102-1) is malfunctioning, the associated first disable device (106-1) may prevent subsequent activation pulses from reaching the first actuator (102-1). In so doing, the adverse effects resulting from continuing to operate the first actuator (102-1) can be avoided.

Figure 2A:
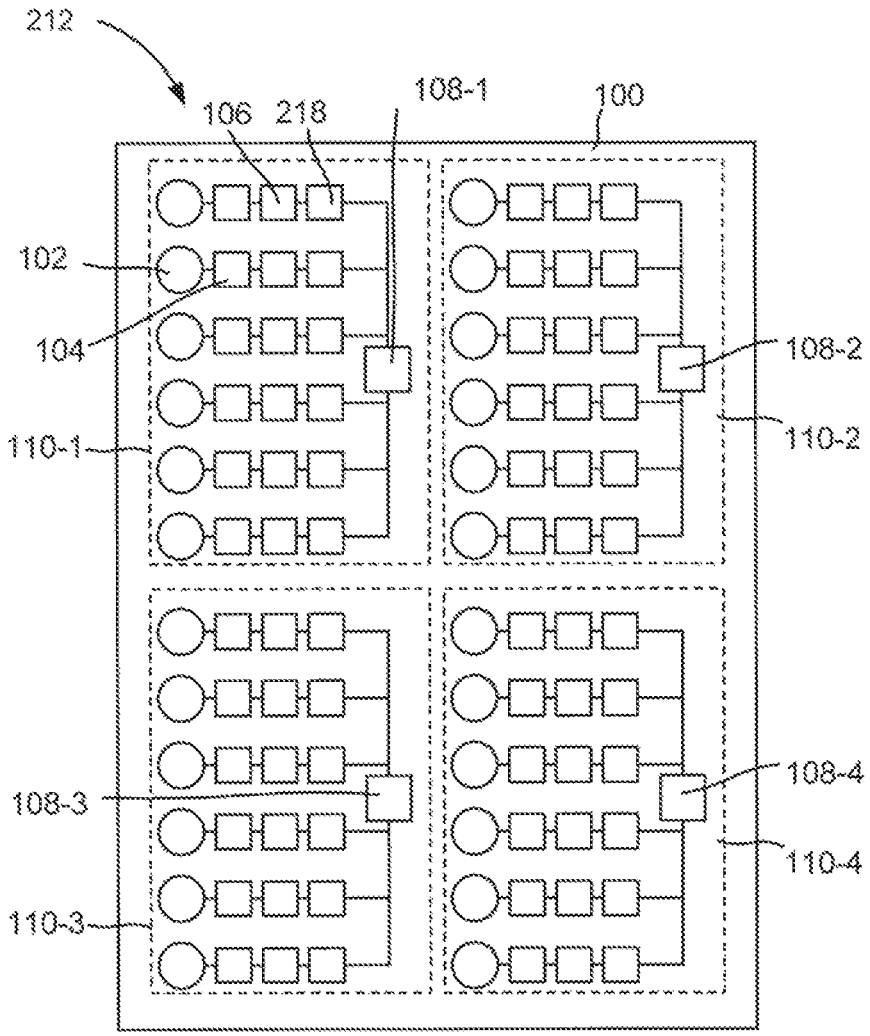
FIG. 2A is a block diagram of a fluid ejection system including on-die actuator disabling and activation-forwarding components, according to an example of the principles described herein.

FIG. 2A is a block diagram of a fluid ejection system (212) including on-die actuator (FIG. 1A, 102) disabling and activation-forwarding components, according to an example of the principles described herein. The system (212) includes a fluid ejection die (100) on which multiple actuators (102) and corresponding actuator sensors (104) are disposed. For simplicity, a single instance of an actuator (102), an actuator sensor (104), a disabling device (106), and a later-described forwarding device (218) are indicated with reference numbers. However, a fluid ejection die (100) may include any number of actuators (102), actuator sensors (104), disabling devices (106), and forwarding devices (218). In the example depicted in FIG. 2A, the actuators (102), actuator sensors (104), disabling devices (106), and forwarding devices (218) are arranged into columns, however these components may be arranged in different arrays. The actuators (102), actuator sensors (104), disabling devices (106), and forwarding devices (218) In each column may be grouped into primitives (110-1, 110-2, 110-3, 110-4). In the case of actuators (102) that are fluid ejection nozzles, one nozzle per primitive (110) is activated at a time. While FIG. 2A depicts six components per primitive (110), primitives (110) may have any number of these components.

Figure 2B:
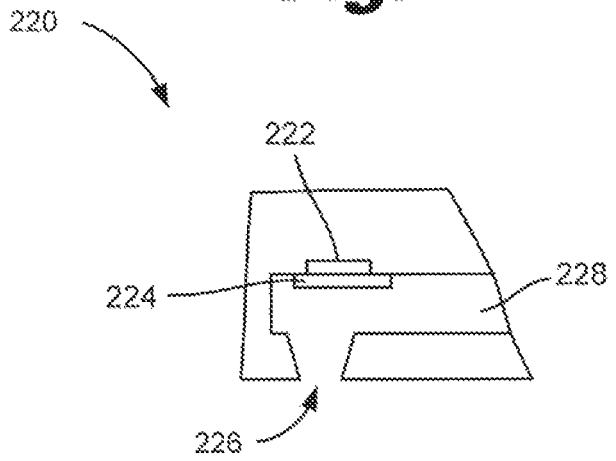
FIG. 2B is a cross-sectional diagram of a nozzle of the fluid ejection system depicted in FIG. 2A, according to an example of the principles described herein.

FIG. 2B is a cross sectional diagram of a nozzle (220). As described above, a nozzle (220) is an actuator (102) that operates to eject fluid from the fluid ejection die (100) which fluid is initially disposed in a fluid reservoir that is fluidically coupled to the fluid ejection die (100). To eject the fluid, the nozzle (220) includes various components. Specifically, a nozzle (220) includes an ejector (222), an ejection chamber (228), and a nozzle orifice (226). The nozzle orifice (226) may allow fluid, such as ink, to be deposited onto a surface, such as a print medium. The ejection chamber (228) may hold an amount of fluid. The ejector (222) may be a mechanism for ejecting fluid from the ejection chamber (228) through the nozzle orifice (226), where the ejector (222) may include a firing resistor or other thermal device, a piezoelectric element, or other mechanism for ejecting fluid from the ejection chamber (228).

In the case of a thermal inkjet operation, the ejector (222) is a heating element. Upon receiving the firing signal, the heating element initiates heating of the ink the ejection chamber (228). As the temperature of the fluid in proximity to the heating element increases, the fluid may vaporize and form a drive bubble. As the heating continues, the drive bubble expands and forces the fluid out of the nozzle orifice (226). As the vaporized fluid bubble collapses, a negative pressure within the ejection chamber (228) draws fluid into the ejection chamber (228) from the fluid supply, and the process repeats. This system is referred to as a thermal inkjet system.

FIG. 2B also depicts a drive bubble detection device (224). The drive bubble detection device (224) depicted in FIG. 2B is an example of an actuator sensor (104) depicted in FIG. 2A. Accordingly, as with the actuator sensors (104), each drive bubble detection device (224) is coupled to a respective actuator (102) of the number of actuators (102) and the drive bubble detection devices (224) are part of a primitive (110) to which the corresponding actuator (102) is a component.

The drive bubble detection device (224) may include a single electrically conductive plate, such as a tantalum plate, which can detect impedance of whatever medium is within the ejection chamber (228). Specifically, each drive bubble detection device (224) measures an impedance of the medium within the ejection chamber (228), which impedance measure can indicate whether a drive bubble is present in the ejection chamber (228). The drive bubble detection device (224) then outputs a first voltage value indicative of a state, i.e., drive bubble formed or not, of the corresponding nozzle (220). This output can be compared against a threshold voltage to determine whether the nozzle (220) is malfunctioning or otherwise inoperable.

Returning to FIG. 2A, the system (212) also includes a number of actuator evaluation devices (108-1, 108-2, 108-3, 108-4). Specifically, the system (212) includes an actuator evaluation device (108) per primitive. That is, each of the actuator evaluation devices (108-1, 108-2, 108-3, 108-4) may be uniquely paired with a corresponding primitive (110-1, 110-2, 110-3, 110-4). That is a first primitive (110.1) may be uniquely paired with a first actuator evaluation device (108-1). Similarly, a second primitive (110-2), third primitive (110-3), and a fourth primitive (110-4) may be uniquely paired with a second actuator evaluation device (108-2), third actuator evaluation device (108-3), and fourth actuator evaluation device (108-4), respectively. In one example, each actuator evaluation device (108) corresponds to just the number of actuators (102) and just the number of actuator sensors (104) within that particular primitive (110).

The actuator evaluation devices (108) evaluate a characteristic of the actuators (102) within their corresponding primitive (110) based at least in part on an output of an actuator sensor (104) corresponding to the actuator (102), and a threshold voltage. That is, an actuator evaluation device (108) identifies a malfunctioning actuator (102) within its primitive (110). For example, a threshold voltage may be such that a voltage lower than the threshold would indicate an actuator sensor (104) in contact with fluid and a voltage higher than the threshold voltage would indicate an actuator sensor (104) that is in contact with fluid vapor. Accordingly, per this comparison of the threshold voltage and the first voltage, it can be determined whether vapor or fluid is in contact with the actuator sensor (104) and accordingly, whether an expected drive bubble has been formed. While one particular relationship, i.e., low voltage indicating fluid and high voltage indicating vapor, has been presented, other relationships could exist. i.e., high voltage indicating fluid and low voltage indicating vapor.

Including the actuator evaluation device (108) on the fluid ejection die (100) improves the efficiency of actuator evaluation. For example, in other systems, any sensing information collected by an actuator sensor (104) is not per actuator (102), nor is it assessed on the fluid ejection die (100), but is rather routed off the fluid ejection die (100) to a printer, which increases communication bandwidth between the fluid ejection die (100) and the printer in which it is installed. Moreover such primitive/actuator evaluation device pairing allows for the localized "in primitive" assessment which can be used locally to disable a particular actuator (102), without involving the printer or the rest of the fluid ejection die (100).

Including an actuator evaluation device (108) per primitive (214) increases the efficiency of actuator evaluation. For example, were the actuator evaluation device (108) to be located off die, while one actuator (102) is being tested, all the actuators (102) on the die (100), not just those in the same primitive (110), would be deactivated so as to not interfere with the testing procedure. However, where testing is done at a primitive (110) level, other primitives (110) of actuators (102) can continue to function to eject or move fluid. That is, an actuator (102) corresponding to the first primitive (110-1) may be evaluated while actuators (102) corresponding to the second primitive, (110-2), the third primitive (110-3), and the fourth primitive (110-4) may continue to operate to deposit fluid to form printed marks. Moreover, including an actuator evaluation device (108) per primitive (110) as opposed to per actuator (102) saves space, and is more efficient at determining actuator performance.

Following this comparison, the actuator evaluation devices (108) may generate an output indicative of a failing actuator of the fluid ejection die (100). This output may be a binary output, which could be used by downstream systems to carry out any number of operations. Instantiating an actuator evaluation device (108) per primitive (110) also reduces the on-die circuitry.

FIG. 2A also depicts a number of forwarding devices (218). As with the disabling devices (106) and actuator sensors (104), the forwarding devices (218) may be instantiated at a per-actuator (102) level. That is, each forwarding device (218) of the number of forwarding devices (218) may be coupled to one respective actuator (102) of the number of actuators (102), and in some cases may be uniquely paired with the respective actuator (102). The forwarding devices (218) operate to forward an activation pulse originally directed towards the corresponding actuator (102), to another actuator (102), when the corresponding actuator (102) is determined to be malfunctioning. That is, in addition to disabling a particular actuator (102) that is malfunctioning or otherwise inoperable, the components on the fluid ejection die (100) allow for a replacement actuator (102) such that operation of the device can continue regardless of the failed state of any actuator (102).

That is, a first forwarding device (218) corresponding to a first actuator (102) may pass an activation pulse originally intended for the first actuator (102) to a second actuator (102), when the actuator evaluation device (108) corresponding to the first actuator (102) determines the first actuator (102) to be malfunctioning or otherwise inoperable. In other words, the second actuator (102) replaces the operation of the first actuator (102). In some examples, the second actuator (102) that replaces the initial actuator (102) may be the nearest actuator (102) to the first actuator (102). For example, it may be the same vertically-indexed actuator (102), but in a different column. In another example, the second actuator (102) may be a neighboring actuator (102) in the same column.

As the actuators (102) are closely spaced together, such a replacement may not be discernable on the final product. Moreover, this replacement ensures that any adverse effects of operating the malfunctioning actuator (102) can be minimized.

Figure 3:
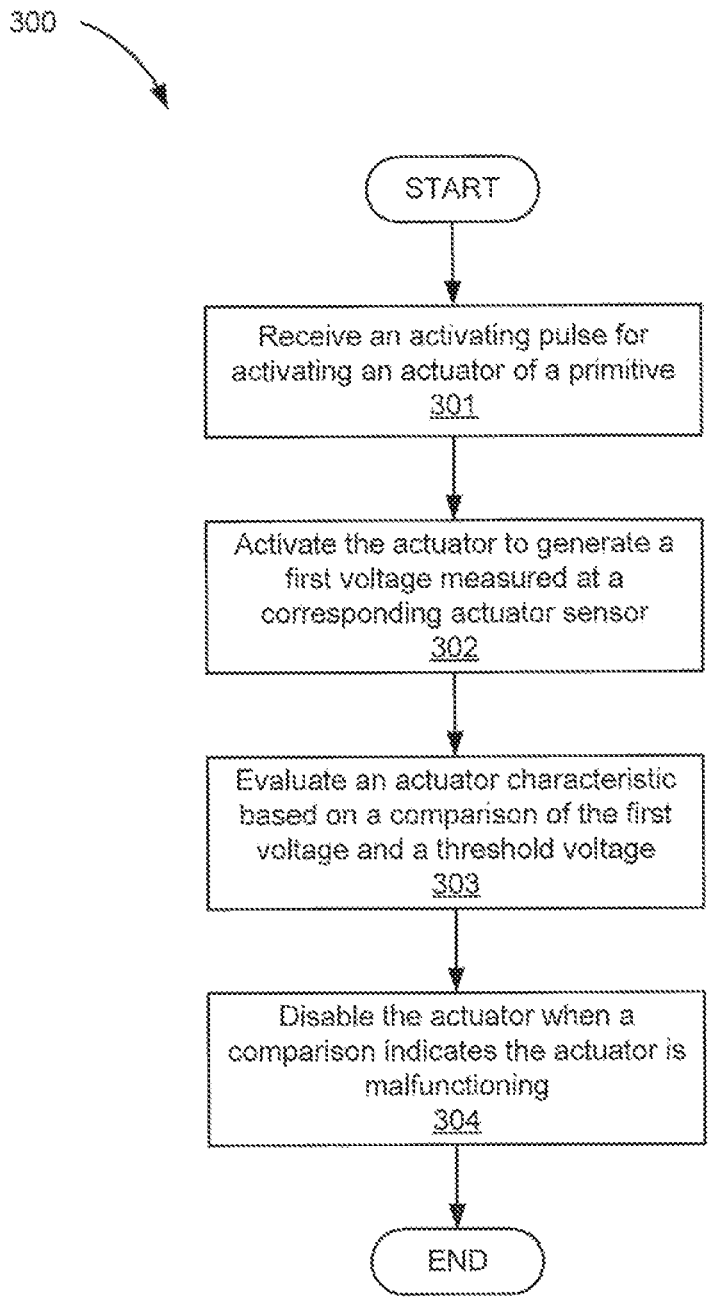
FIG. 3 is a flowchart of a method for performing on-die actuator disabling evaluation, according to an example of the principles described herein.

FIG. 3 is a flowchart of a method (300) for performing on-die actuator disabling, according to an example of the principles described herein. According to the method (300), an activation pulse is received (block 301) at an actuator (FIG. 1A, 102). That is, a controller, or other off-die device, sends an electrical impulse that initiates an activation event. For a non-ejecting actuator, such as a recirculation pump, the activation pulse may activate a component to move fluid throughout the fluid channels and fluid slots within the fluid ejection die (FIG. 1A, 100). In a nozzle (FIG. 2B, 220), the activation pulse may be a firing pulse that causes the ejector (FIG. 2B, 222) to eject fluid from the ejection chamber (FIG. 2B, 228).

In the specific example of a nozzle, the activation pulse may include a pre-charge pulse that primes the ejector (FIG. 2B, 222). For example, in the case of a thermal ejector, the pre-charge may warm up the heating element such that the fluid inside the ejection chamber (FIG. 2B, 228) is heated to a near-vaporization temperature. After a slight delay, a firing pulse is passed, which heats the heating element further so as to vaporize a portion of the fluid inside the ejection chamber (FIG. 2B, 228). Receiving (block 301) the activation pulse at an actuator (FIG. 1A, 102) to be actuated may include directing a global activation pulse to a particular actuator (FIG. 1A, 102). That is, the fluid ejection die (FIG. 1A, 100) may include an actuator select component that allows the global activation pulse to be passed to a particular actuator for activation. The actuator (FIG. 1A, 102) that is selected is part of a primitive (FIG. 2A, 214). It may be the case, that one actuator (FIG. 1A, 102) per primitive (FIG. 2A, 214) may be activated at any given time.

Accordingly, the selected actuator (FIG. 1A, 102) is activated (block 302) based on the activation pulse. For example, in thermal inkjet printing, the heating element in a thermal ejector (FIG. 2A, 222) is heated so as to generate a drive bubble that forces fluid out the nozzle orifice (FIG. 2B, 226). The firing of a particular nozzle (FIG. 2A, 220) generates a first voltage output by the corresponding actuator sensor (FIG. 1A, 104), which output is indicative of an impedance measure at a particular point in time. That is, each actuator sensor (FIG. 1A, 104) Is coupled to, and in some cases, uniquely paired with, an actuator (FIG. 1A, 102). Accordingly, the actuator sensor (FIG. 1A, 104) that is uniquely paired with the actuator (FIG. 1A, 102) that has been fired outputs a first voltage.

To generate the first voltage, a current is passed to an electrically conductive plate of the actuator sensor (FIG. 1A, 104), and from the plate into the fluid or fluid vapor. For example, the actuator sensor (FIG. 1A, 104) may include a single conductive plate disposed between the ejector (FIG. 2B, 222) and the ejection chamber (FIG. 2B, 228). As this current is passed to the actuator sensor (FIG. 1A, 104) plate, and from the plate, into the fluid or fluid vapor, an impedance is measured and a first voltage determined.

In some examples, activating (block 302) the actuator (FIG. 1A, 102) to obtain a first voltage for activator evaluation may be carried out during the course of forming a printed mark. That is, the firing event that triggers an actuator evaluation may be a firing event to deposit fluid on a portion of the media intended to receive fluid. In other words, there is no dedicated operation relied on for performing activator evaluation, and there would be no relics of the activator evaluation process as the ink is deposited on a portion of an image that was intended to receive fluid as part of the printing operation.

In another example, the actuator (FIG. 1A, 102) is activated (block 302) in a dedicated event independent of a formation of a printed mark. That is, the event that triggers an actuator evaluation may be in addition to a firing event to deposit fluid on a portion of the media intended to receive fluid. That is the actuator may fire over negative space on a sheet of media, and not one intended to receive ink to form an image.

An actuator characteristic is then evaluated (block 303) based at least in part on a comparison of the first voltage and the threshold voltage. In this example, the threshold voltage may be selected to clearly indicate a blocked, or otherwise malfunctioning, actuator (FIG. 1A, 102). That is, the threshold voltage may correspond to an impedance measurement expected when a drive bubble is present in the ejection chamber (FIG. 2B, 228), i.e., the medium in the ejection chamber (FIG. 2B, 228) at that particular time is fluid vapor. Accordingly, if the medium in the ejection chamber (FIG. 2B, 228) were fluid vapor, then the received first voltage would be comparable to the threshold voltage. By comparison, if the medium in the ejection chamber (FIG. 2B, 228) is print fluid such as ink, which may be more conductive than fluid vapor, the impedance would be lower and a lower voltage would be output. Accordingly, the threshold voltage is configured such that a voltage lower than the threshold indicates the presence of fluid, and a voltage higher than the threshold indicates the presence of fluid vapor. If the first voltage is thereby greater than the threshold voltage, it may be determined that a drive bubble is not present and if the first voltage is lower than the threshold voltage, it may be determined that a drive bubble is present when it should be, and a determination made that the nozzle (FIG. A, 102) is not performing as expected. While specific reference is made to output a low voltage to indicate low impedance, in another example, a high voltage may be output to indicate low impedance.

In some examples, the threshold voltage against which the first voltage is compared depends on an amount of time passed since the activation of the actuator (FIG. 1A, 102). For example, as the drive bubble collapses, the impedance in the ejection chamber (FIG. 2B, 228) changes over time, slowly returning to a value indicating the presence of fluid. Accordingly, the threshold voltage against which the first voltage is compared also changes over time.

When the actuator (FIG. 1A, 102) under test is determined to be malfunctioning or otherwise inoperable, it can be disabled (block 304). That is, it is prevented from subsequent activations. Doing so ensures that any ill effects of operating a malfunctioning actuator (FIG. 1A, 102) can be avoided. For example, if allowed to continually operate in a malfunctioning state, the malfunctioning actuator (FIG. 1A 102) could cause other actuators (FIG. 1A, 102) to fail in a cascading fashion.

Disabling (block 304) the actuator (FIG. 1A 102) can include preventing subsequent activation signals originally intended for the actuator (FIG. 1A, 102) from passing to the actuator (FIG. 1A, 102). These activation signals can instead be routed, or forwarded to a different actuator (FIG. 1A, 102). Accordingly, the present actuator (FIG. 1A, 102) is disabled. As described, by preventing the activation signal from reaching the intended actuator (FIG. 1A, 102), the actuator (FIG. 1A, 102) is disabled. By forwarding the activation signal to another actuator (FIG. 1A, 102), the disabled actuator (FIG. 1A 102) is replaced with a functioning actuator (FIG. 1A, 102).

In some examples, the disablement may be permanent, in other examples it may be resettable. That is, in some examples, after an actuator (FIG. 1A, 102) or set of actuators (FIG. 1A, 102) have been disabled, they may be reset such that activation signals intended for those actuators (FIG. 1A, 102) may pass. Such resetting may occur after a predetermined period of time, and allows for a re-testing of particular actuators (FIG. 1A, 102) to see if for whatever reason, the problem may have self-corrected or to account for some actuator (FIG. 1A, 102) service or repair.

Figure 4:
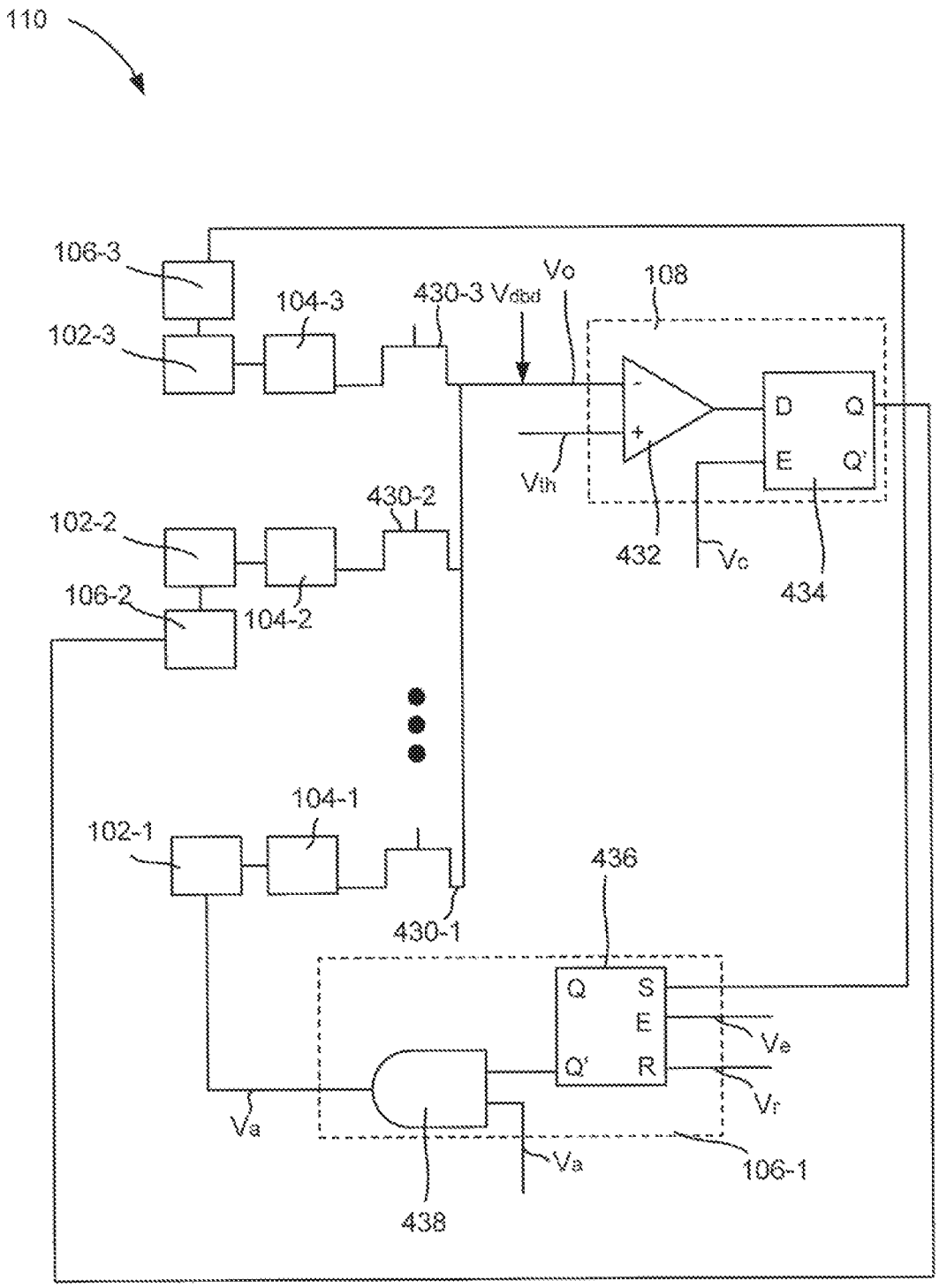
FIG. 4 is a circuit diagram of on-die actuator evaluation and disabling components, according to another example of the principles described herein.

FIG. 4 is a circuit diagram of on-die actuator evaluation and disable components, according to another example of the principles described herein. Specifically, FIG. 4 is a circuit diagram of one primitive (110). As described above, the primitive (110) includes a number of actuators (102) and a number of actuator sensors (104) coupled to respective actuators (102). During operation, a particular actuator (102) is selected for activation. While active, the corresponding actuator sensor (104) is coupled to the actuator evaluation device (108) via a selecting transistor (430-1, 430-2, 430-3). That is, the selecting transistor (430) forms a connection between the actuator evaluation device (108) and the selected actuator sensor (104). The formation of the connection also allows a current, resulting from applied voltage, $V_{dbd}$, to pass through to the corresponding actuator sensor (104) such that an impedance measure of the ejection chamber (FIG. 2B, 228) within the actuator (102) can be made.

In this example, the actuator evaluation device (108) includes a compare device (432) to compare a voltage output, $V_o$, from one of the number of actuator sensors (104) against a threshold voltage, $V_{th}$, to determine when a corresponding actuator (102) is malfunctioning or otherwise inoperable. That is, the compare device (432) determines whether the output of the actuator sensor (104), $V_o$, is greater than or less than the threshold voltage, $V_{th}$. The compare device (432) then outputs a signal indicative of which is greater.

The output of the compare device (432) may then be passed to an evaluation storage device (434) of the actuator evaluation device (108). In one example, the evaluation storage device (434) may be a latch device that stores the output of the compare device (432) and selectively passes the output on. For example, the actuator sensor (104), the compare device (432), and the evaluation storage device (434) may be operating continuously to evaluate actuator characteristics and store a binary value relating to the state of the actuator (102). Then, when a control signal, $V_c$, is passed to enable the evaluation storage device (434), the information stored in the evaluation storage device (434) is passed on as an output from which any number of subsequent operations can be performed.

In some examples, the actuator evaluation device (108) may process multiple instances of a first voltage against multiple values of a threshold to determine whether an actuator (102) is blocked, or otherwise malfunctioning. For example, over multiple activation events, the first voltage may be sampled at different times relative to the activation event, corresponding to different phases of drive bubble formation and collapse. Each time the first voltage is sampled, it might be compared against a different threshold voltage. In this example, the actuator evaluation device (108) could either have unique latches to store the result of each comparison, or a single latch, and if the sensor voltage is ever outside of the expected range (given the time at which it was sampled), that actuator (102) can be identified as defective. In this case, single latch stores a bit which represents "aggregate" actuator status. In the case of multiple storage devices, each may store the evaluation result for a different sample time, and the aggregate collection of those bits can allow for the identification of not only the actuator state, but also the nature of the malfunction. Knowing the nature of the malfunction can inform the system as to the proper response (replace the nozzle, service the nozzle [i.e. multiple spits or pumps], clean the nozzle, etc.).

An output of the evaluation storage device (434) can be used for any number of subsequent operations. For example, the output of the evaluation storage device (434) can be passed to a disable device (106) corresponding to the actuator (102) being tested. For simplicity, one disable device (106-1) is illustrated in more detail. However, the other disable devices (106-2, 106-3) may include similar components. Specifically, the disable devices (106) may include a disable storage device (436) that is paired with a corresponding actuator (102) and stores an output of the actuator evaluation device (108). That is, the actuator evaluation device (108) can evaluate any nozzle (102) within the primitive (214), and the disable storage device (436) stores the result of an evaluation of a particular actuator (102). In some examples, the disable storage device (436) selectively stores the output of the evaluation storage device (434). That is, a signal, $V_e$, is received at an "E" port of the disable storage device (436) which selectively allows the disable storage device (436) to store, i.e., latch, the output into the disable storage device (436). In this example, if the "E" port is low, any high pulse on the "S" port will be ignored. In other words as a specific example, a disable storage device (436) is enabled when a first actuator (102-1) is being evaluated. In this fashion, other evaluation storage devices can ignore any outputs of the evaluation storage device (434) that are intended for other actuators (102).

The disable storage devices (436) may also be resettable. That is, a signal, $V_r$, at an "R" port of the disable storage device (436), the disable storage device (436) may be reset to a default value so as to allow subsequent analysis of a corresponding nozzle (102).

The disable device (106) also includes a disable gate (438) to regulate passage of an activation signal, $V_a$ based on an output of the disable storage device (436). Returning to the specific example of FIG. 4, the activation signal, $V_a$ may be allowed to pass through to a first actuator (102-1), when the disable storage device (436) does not indicate that the actuator evaluation device (108) has determined the first actuator (102-1) to be malfunctioning or otherwise inoperable.

Figure 5:
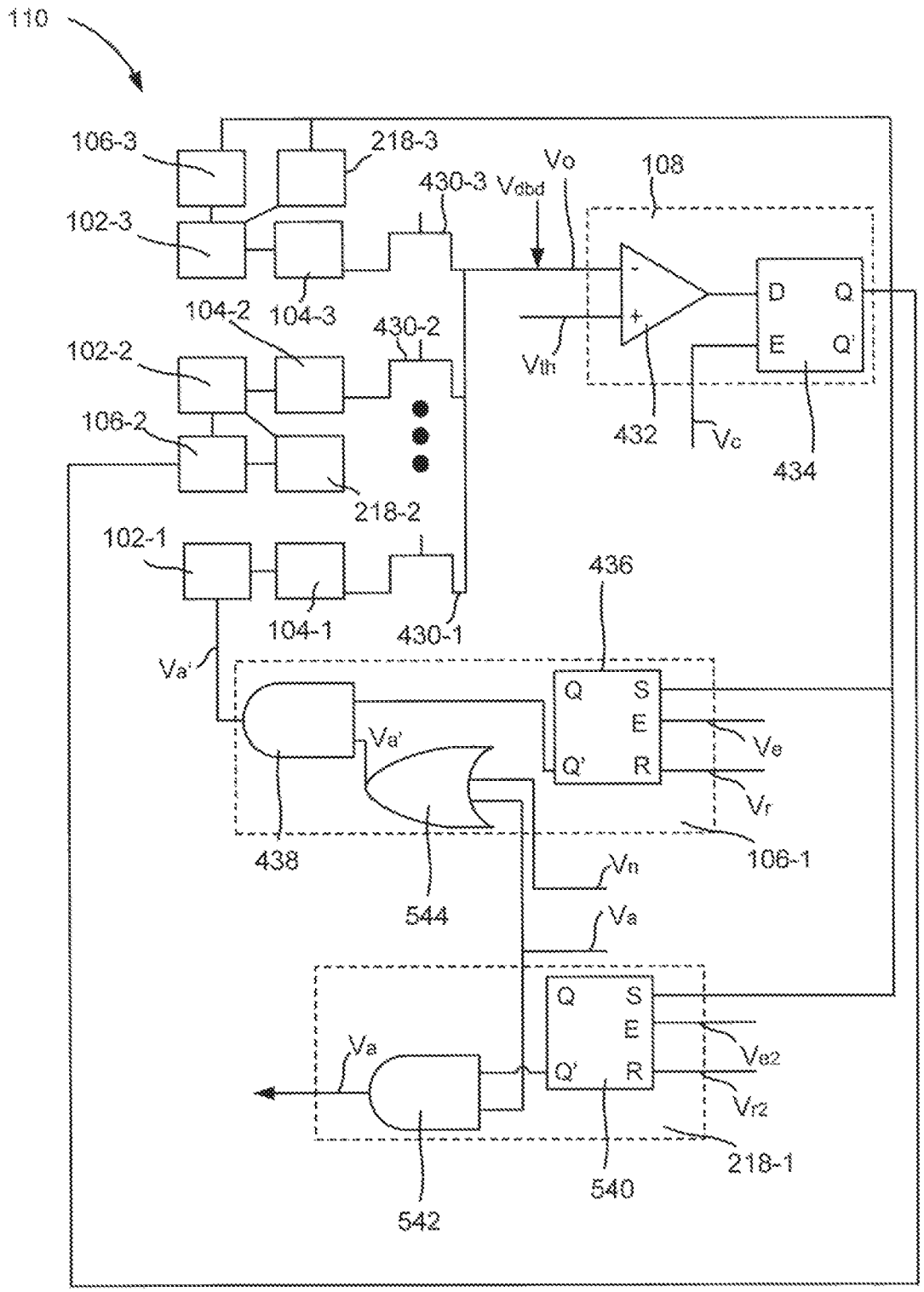
FIG. 5 is a circuit diagram of on-die actuator evaluation, disabling and activation forwarding components, according to another example of the principles described herein.

FIG. 5 is a circuit diagram of on-die actuator evaluation, disabling and activation forwarding components, according to another example of the principles described herein. Specifically, FIG. 5 is a circuit diagram of one primitive (110). In addition to the components described above in relation to FIG. 4, FIG. 5 also depicts a number of forwarding devices (218-1, 218-2, 218-3). For simplicity, one forwarding device (218-1) is illustrated in more detail. However, the other forwarding devices (218-2, 218-3) may include similar components. Specifically, the forwarding devices (218) may include a forward storage device (540) that is paired with a corresponding actuator (102) and stores an output of the actuator evaluation device (108). That is, the actuator evaluation device (108) can evaluate any actuator (102) within the primitive (110), and the forwarding storage device (540) stores the result of an evaluation of a particular actuator (102). In some examples, the forwarding storage device (540) selectively stores the output of the evaluation storage device (434). That is, a signal, $V_{e2}$, is received at an "E" port of the forwarding storage device (540) which selectively allows the forwarding storage device (540) to store, i.e., latch, the output into the forwarding storage device (540). The forwarding storage devices (540) may also be resettable. That is, responsive to an input, $V_{r2}$, on an "R" terminal of the forwarding storage device (540), the forwarding storage device (540) may be reset to a default value so as to allow subsequent analysis of a corresponding actuator (102).

The forwarding device (218) also includes a forward gate (542) to regulate forwarding of an activation signal, $V_a$, based on an output of the forward storage device (540). As a specific example, an activation signal, $V_a$, may be allowed to pass through to a neighbor actuator (102), i.e. any other actuator than the first actuator (102-1), when the forwarding storage device (540) indicates that the actuator evaluation device (108) has determined the first actuator (102-1) to be malfunctioning or otherwise inoperable. Note that the outputs of the disable device (108) and forward device (218) respond differently given a similar input. That is, the disable device (106-1) disallows sending of an activation pulse based on a determination of a malfunctioning first actuator (102-1) while the forwarding device (218-1) allows sending of an activation pulse based on a determination of a malfunctioning first actuator (102-1).

In this example, to manage an incoming signal from a neighboring actuator (102), for example, the second actuator (102-2) that has failed, the disable device (106) may include additional components such as an "OR" gate (544). That is, the "OR" gate (544) may generate a qualified activation signal, $V_{a'}$ when either an activation signal, $V_a$, is directed to the first actuator (102-1) or an activation signal forwarded from the second actuator (102-2), $V_n$, which second actuator (102-2) is malfunctioning, has been forwarded to the first actuator (102-1). Note that the qualified activation signal. $V_{a'}$, is still subject to the disable gate (438) to ensure it does not pass to the first actuator (102-1) when an output of the disable storage device (436) indicates the first actuator (102-1) Is malfunctioning or otherwise inoperable. That is, an actuator (102) is activated when 1) an activation signal directed to a different actuator (102) is forwarded onto the actuator (102) and the actuator (102) is not malfunctioning or 2) an activation signal is directed to the actuator (102) and the actuator (102) is not malfunctioning.

Figure 6:
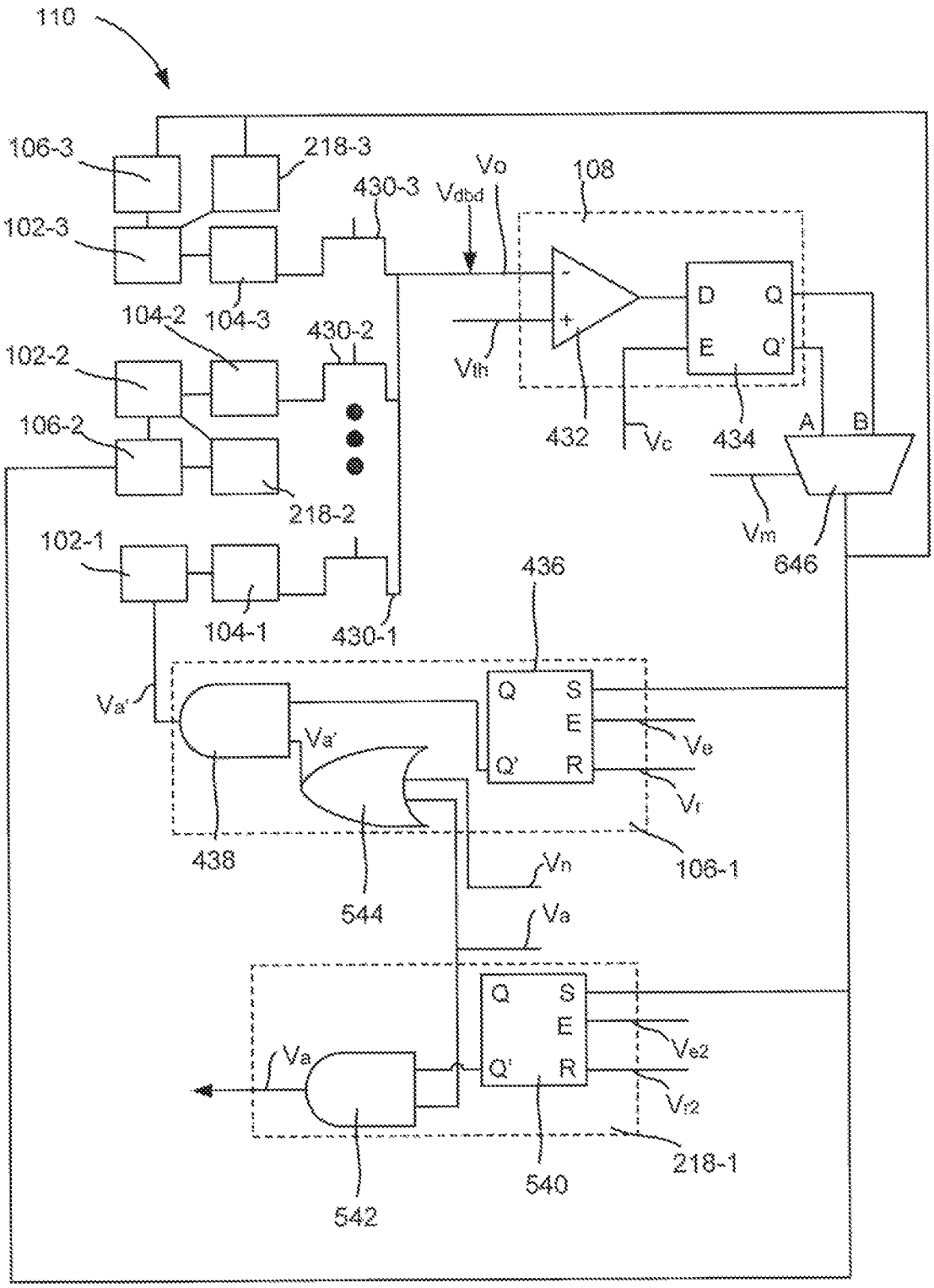
FIG. 6 is a circuit diagram of on-die actuator evaluation, disabling and activation forwarding components, according to another example of the principles described herein.

FIG. 6 is a circuit diagram of on-die actuator evaluation, disabling and activation forwarding components, according to another example of the principles described herein. Specifically, FIG. 6 is a circuit diagram of one primitive (110). In addition to the components described above, FIG. 6 also depicts a multiplexing device (646) to select which output of the evaluation storage device (434) to observe. In other words, the multiplexing device (646) allows for one evaluation storage device (434) to be used perform two different evaluations at two different times. The first may consider whether the output voltage, $V_o$, is larger than the threshold, $V_{th}$. In that case, one of the Q, Q' outputs is considered and the multiplexing device (646) selects which of Q and Q' to observe. At a later point in time, the output voltage, $V_o$, may be evaluated to determine if it is smaller than the threshold $V_{th}$. In this case, the other of Q and Q' would be considered and the multiplexing device (646) selects which of Q and Q' to observe.

As a specific numeric example, the threshold voltage, $V_{th}$, may first be set at 3V and the actuator evaluation device (108) can compare an output voltage, $V_o$, of a particular actuator sensor (104) against this threshold voltage, $V_{th}$, to determine if $V_o$ is greater than $V_{th}$. $V_o$, being greater than $V_{th}$ may indicate an actuator (102) is bad. The threshold voltage, $V_{th}$, may then be changed to 2.5V and the $V_o$ tested against this to determine if $V_o$ is lower than $V_{th}$. $V_o$ lower than this second threshold voltage may also indicate that the associated actuator (102) is malfunctioning or otherwise inoperable. A "greater than threshold result" would output one logical value, and a "less than threshold result" may output a different logical value. Accordingly, the first input of the multiplexing device (646) would be tied to a Q value for the evaluation storage device (434) and the second input would be tied to the Q' value for the evaluation storage device (434).

As can be seen in FIG. 6, the multiplexing device (646) is paired with multiple nozzles and outputs either a sub-first threshold output or an above-second threshold output based on a control signal, $V_m$, which activates the multiplexing device (646).

In summary, using such a fluid ejection die 1) allows for actuator evaluation, disabling, and replacement circuitry to be disposed on the die itself, as opposed to sending sensed signals to nozzle evaluation circuitry off die; 2) increases the efficiency of bandwidth usage between the device and die; 3) reduces computation overhead for the device in which the fluid ejection die is disposed; 4) provides improved resolution times for malfunctioning actuators; 5) allows for actuator evaluation in one primitive while allowing continued operation of actuators in another primitive; and 6) places management of nozzles on the fluid ejection die as opposed to on the printer in which the fluid ejection die is installed. However, it is contemplated that the devices disclosed herein may address other matters and deficiencies in a number of technical areas.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid ejection die comprising:

a number of actuator sensors disposed on the fluid ejection die to sense a characteristic of a corresponding actuator, wherein:

each actuator sensor is coupled to a respective actuator; and multiple coupled actuator sensors and actuators are grouped as primitives on the fluid ejection die;

an actuator evaluation device per primitive to evaluate an actuator characteristic of any actuator within the primitive; and a disable device per actuator, wherein each disable device:

is coupled to a respective actuator; and is to disable a corresponding actuator when the corresponding actuator is determined to be malfunctioning.

2. The fluid ejection die of claim 1, further comprising a number of forwarding devices to selectively forward an activation signal originally directed towards a first actuator to a second actuator, when the first actuator is determined to be malfunctioning, wherein each forwarding device is coupled to a respective actuator.

3. The fluid ejection die of claim 2, wherein the forwarding device comprises:

a forwarding storage device unique to the first actuator to selectively store an output of the actuator evaluation device regarding a state of the first actuator; and a gate to regulate forwarding of the activation signal based on an output of the forwarding storage device.

4. The fluid ejection die of claim 1, wherein:

the actuator evaluation device comprises:

a compare device to compare a first voltage output from one of the number of actuator sensors against a threshold voltage to determine when a corresponding actuator is malfunctioning; and an actuator evaluation storage device to:

store an output of the compare device; and selectively pass the stored output as indicated by a control signal; and a disable device comprises:

a disable storage device paired with the corresponding actuator to selectively store an output of the actuator evaluation device; and a disable gate to regulate passage of an activation signal intended for the corresponding actuator based on an output of the disable storage device.

5. The fluid ejection die of claim 4, wherein at least one of the actuator evaluation storage device and the number of disable storage devices are resettable.

6. The fluid ejection die of claim 1 wherein, a second actuator activates when:

an activation signal directed to a first actuator is forwarded to the second actuator and the second actuator is not malfunctioning;

an activation signal is directed to the second actuator and the second actuator is not malfunctioning; or combinations thereof.

7. The fluid ejection die of claim 1, further comprising a multiplexing device to select an output of the actuator evaluation device to forward on.

8. The fluid ejection die of claim 7, wherein the multiplexing device is paired with the multiple actuators of a primitive.

9. The fluid ejection die of claim 7, wherein the multiplexing device outputs either of a sub-first threshold output or an above-second threshold output based on a control signal input.

10. The fluid ejection die of claim 1, wherein the actuator evaluation device comprises a compare device to compare a first voltage output from one of the number of actuator sensors against a threshold voltage to determine when a corresponding actuator is malfunctioning.

11. The fluid ejection die of claim 10, wherein the threshold voltage is based on an amount of time passed since the activation of the actuator.

12. The fluid ejection die of claim 1, wherein an actuator sensor takes multiple measurements following a firing event.

13. The fluid ejection die of claim 12, wherein the actuator evaluation device comprises a single latch to store a comparison of the multiple measurements against multiple threshold voltages.

14. The fluid ejection die of claim 12, wherein the actuator evaluation device comprises multiple latches, each to store a comparison of a measurement against a corresponding threshold voltage.

15. A fluid ejection system comprising:

multiple fluid ejection dies, wherein a fluid ejection die comprises:

a number of drive bubble detection devices to output a first voltage indicative of a state of a corresponding actuator, wherein:

each drive bubble detection device is coupled to a respective actuator; and multiple coupled drive bubble detection devices and actuators are grouped as primitives on the fluid ejection die;

an actuator evaluation device per primitive to evaluate an actuator characteristic of the actuator based at least in part on a comparison of the first voltage and a threshold voltage;

a number of disable devices, wherein each disable device:

is coupled to a respective actuator; and is to disable a corresponding actuator when the corresponding actuator is determined to be malfunctioning; and a number of forwarding devices, wherein each forwarding device is coupled to a respective actuator to forward an activation signal originally directed towards the first actuator to a second actuator, when the first actuator is determined to be malfunctioning.

16. The system of claim 15, wherein the second actuator is the nearest actuator to the first actuator on the fluid ejection device.

17. A method comprising:

receiving an activation pulse for activating an actuator of a primitive on a fluid ejection die;

activating the actuator based on the activation pulse to generate a first voltage measured at a corresponding actuator sensor, wherein the corresponding actuator sensor:

is disposed on the fluid ejection die; and is coupled to the actuator; and evaluating an actuator characteristic of the actuator based at least in part on a comparison of the first voltage and a threshold voltage; and disabling, via a disable device uniquely paired with the actuator, the actuator when a comparison indicates the selected actuator is malfunctioning.

18. The method of claim 17, wherein disabling the selected actuator comprises preventing an activation signal directed to the actuator from reaching the actuator via a logic gate.

19. The method of claim 17, further comprising forwarding an activation signal directed to the actuator to a different actuator when the comparison indicates the actuator is malfunctioning.

20. The method of claim 17, further comprising resetting any disabled actuators such that activation signals directed to disabled actuators are allowed to pass to the disabled actuators.

* * * * *